US006892686B2

(12) United States Patent
Pachmann et al.

(10) Patent No.: US 6,892,686 B2
(45) Date of Patent: May 17, 2005

(54) MAGNET ACTUATOR FOR A CAMSHAFT CONTROLLER

(75) Inventors: Klaus Pachmann, Gemmingen (DE); Jens Nicolai, Neupetershein (DE); Harald Barth, Korntal (DE); Kai Elmering, Steinbach (DE); Ludwig Freund, Bietigheim-Bissingen (DE)

(73) Assignee: Valeo Schalter and Sensoren GmbH, Bietigheim-Bissingen (DE)

( * ) Notice: Subject to any disclaimer, the term of this patent is extended or adjusted under 35 U.S.C. 154(b) by 0 days.

(21) Appl. No.: 10/286,783

(22) Filed: Nov. 4, 2002

(65) Prior Publication Data

US 2003/0084862 A1 May 8, 2003

(30) Foreign Application Priority Data

Nov. 7, 2001 (DE) ..... 101 54 212
Apr. 10, 2002 (DE) ..... 102 15 727

(51) Int. Cl.[7] ..... F01M 9/10

(52) U.S. Cl. ..... 123/90.38; 123/90.13; 123/90.34; 123/90.15

(58) Field of Search ..... 123/90.11, 90.12, 123/90.13, 90.33–90.38, 90.18, 90.15, 90.16, 90.17

(56) References Cited

U.S. PATENT DOCUMENTS 4,454,856 A * 6/1984 Fox et al. ..... 123/617
4,805,571 A * 2/1989 Humphrey ..... 123/316
4,917,058 A * 4/1990 Nelson et al. ..... 123/90.17
5,842,457 A * 12/1998 Terakado et al. ..... 123/613
5,927,240 A * 7/1999 Maxon ..... 123/179.3
6,167,855 B1 * 1/2001 Mammarella et al. ... 123/90.38
6,541,959 B2 * 4/2003 Gudgeon et al. ..... 324/207.15
2002/0118012 A1 * 8/2002 Gudgeon et al. ..... 324/207.15

FOREIGN PATENT DOCUMENTS

DE 196 54 926 11/1997
DE 199 55 507 6/2001

* cited by examiner

*Primary Examiner*—Thomas Denion
*Assistant Examiner*—Jaime Corrigan
(74) *Attorney, Agent, or Firm*—Paul Vincent

(57) ABSTRACT

The invention concerns a magnet actuator for a camshaft controller, comprising a housing base body with receiving sections provided on the housing base body for receiving at least one magnetic body, wherein the magnetic body is provided for driving an actuating means which is disposed coaxially to the camshaft and which controls the camshaft. The invention is characterized in that the housing base body is made from plastic material, in particular fiber glass reinforced plastic material and that conductor paths are provided on the plastic material or injected into the plastic material which connect a central electric connection to the at least one magnet body and/or to the sensor elements detecting adjustment or motion of the camshaft.

18 Claims, 3 Drawing Sheets

MAGNET ACTUATOR FOR A CAMSHAFT CONTROLLER

This application claims Paris Convention priority of DE 101 54 212.7 filed Nov. 7, 2001 and DE 102 15 727.8 filed Apr. 10, 2002 the complete disclosure of which are hereby incorporated by reference.

BACKGROUND OF THE INVENTION

The invention concerns a magnet actuator for a camshaft controller, comprising a housing base body with receiving sections provided on the housing base body for receiving at least one magnet body, wherein the magnet body is provided for driving an actuating means which is disposed coaxially to the camshaft and which controls the camshaft. The actuating means may include, in particular, hydraulic valves which can be actuated in an axial direction by the magnet body.

Conventional magnet actuators have a housing base body of cast metal, in particular cast aluminium. The magnet bodies are screwed to the housing base body. Cabling is required to provide the magnet body with electrical current. Camshaft controllers of this type are known e.g. from DE 196 54 926 A1 or DE 199 55 507 A1. These camshaft controllers are disposed in the drive train connection between the camshaft and the crankshaft and are borne via a central tensioning bolt which engages coaxially to and into the camshaft thereby providing connection thereto. In its region adjacent to the camshaft, the tensioning bolt bears the transmission parts of the camshaft controller which can be mutually turned to adjust the phase position of the camshaft relative to the crankshaft. The tensioning bolt is centered with respect to the camshaft which, proximate the region where the bolt shaft joins the camshaft, houses a spool valve which can be displaced by the magnet actuator. The magnet actuator can be fixed relative to the housing of the combustion engine and the armature cooperating with the magnet actuator is connected to the spool valve. This arrangement of the magnet actuator on the outside of the housing of the combustion engine is advantageous in that the magnet actuator can be oriented relative to the armature after assembly of the camshaft and the camshaft controller such that relatively small separations remain between the magnet body and the armature as is required to realize sufficiently large actuating forces with relatively small coil and magnet body sizes.

It is the underlying purpose of the present invention to provide a magnet actuator which is simple and inexpensive to produce and which preferably requires less cabling.

SUMMARY OF THE INVENTION

This object is achieved in accordance with the invention with a magnet actuator of the above-mentioned type in that the housing base body is made from plastic, in particular fiber glass reinforced plastic, and conductor paths are disposed on the plastic material or injected into the plastic material which connect a central electric connection to the at least one magnet body and/or to sensor elements detecting the adjustment or motion of the camshaft. The plastic material is preferably a thermoplastic material. The invention is advantageous in that, starting from the central connection, all components which require electric current are fed through the conductor paths. Cabling of the magnet bodies is consequently eliminated. If the conductor paths are injected into the plastic material, it is advantageous when they are not accessible and consequently cannot be damaged. The number of electric plug connections is minimized and the number of device components is also reduced. The overall inventive magnet actuator is very compact.

In an advantageous embodiment of the invention, the housing base body has pockets for receiving the sensor elements. Advantageously, separate protective housings for the sensor elements are thereby not required. The sensor elements can be embedded into the housing base body such that they cannot be accessed or only accessed with great difficulty. To safely fix the sensor elements, they can be cast with an appropriate plastic material after insertion into the respective pockets.

The pockets are preferably disposed in the region between two receiving sections. This is advantageous, since the pockets or the sensor elements are then close to one another so that the conductor paths can be kept relatively short and are therefore insensitive to failure as well as easy to mount.

In a further advantageous embodiment of the invention, the sensor elements are disposed on a circuit board. This is advantageous in that additional required electric components are collectively pre-mounted and can be handled as a unit.

Several sensor elements (preferably all) are advantageously disposed on one circuit board. In this manner, the sensor elements can be pre-mounted and handled together with the common circuit board to consequently reduce the material and production effort.

The housing base body preferably has a recepticle for the circuit board. The circuit board is protectingly disposed in the recepticle. Advantageously, the circuit board does not project past the housing base body. The surface design of the recepticle preferably corresponds to the mating image of the topography of the circuit board.

The recepticle is preferably in the region between two receiving sections. One board can consequently feed several, in particular, two sensor elements with current. One separate sensor element is provided for detecting the rotary motion of each camshaft.

In an embodiment of the invention, the conductor paths extend from the central connection to the recepticle and contact the circuit board. Additional cabling between the recepticle and the board is thereby eliminated.

In another advantageous embodiment of the invention, the conductor paths are electrically connected to the magnet bodies via the circuit boards. This is advantageous in that only the circuit board must be supplied with current. The magnet bodies are fed with current via the circuit board. If the circuit board is disposed between two receiving sections, it can supply e.g. both magnet bodies with current.

The magnet bodies thereby have electric connecting means which extend to the recepticle and contact the circuit board to eliminate additional cabling between the circuit board and the magnet bodies.

In an advantageous embodiment of the invention, all conductor paths extend parallel to each other and are preferably disposed in a co-planar fashion which, advantageously, eliminates the danger of erroneous contacts due to intersecting conductor paths.

In accordance with the invention, the sensor elements may also extend coaxially to the longitudinal axis of the magnet body or the respective camshaft. This provides very exact and simple mounting of the sensor elements to the housing base body.

In another embodiment of the invention, each sensor element detects one transmitter wheel which is coupled to the respective actuating means or the respective camshaft for secure mutual rotation therewith. The transmitter wheel can be designed such that it emits signals to the sensor element via a certain angular region. At least sections of the transmitter wheel may also comprise magnetic material, wherein the sensor element is formed as a magnetic field sensor element.

The transmitter wheel is preferably designed as a stamped or bent component. In particular, when the sensor elements extend coaxially to the longitudinal axis of the magnet body, stamped and/or bent parts are suitable whose transmitter sections extend perpendicularly to the longitudinal axis of the sensor elements, of the magnet body, or of the camshaft.

The magnet body is preferably formed as a pressure magnet. When the magnet body is supplied with current, an axial pressure is exerted on the actuating means which cooperate with the magnet body. The actuating means can be returned into its initial position via e.g. a compression spring.

Further advantageous embodiments and details of the invention can be extracted from the following description which shows and describes the invention in more detail with reference to the embodiments shown in the figures.

DESCRIPTION OF THE PREFERRED EMBODIMEND

Figure 1:
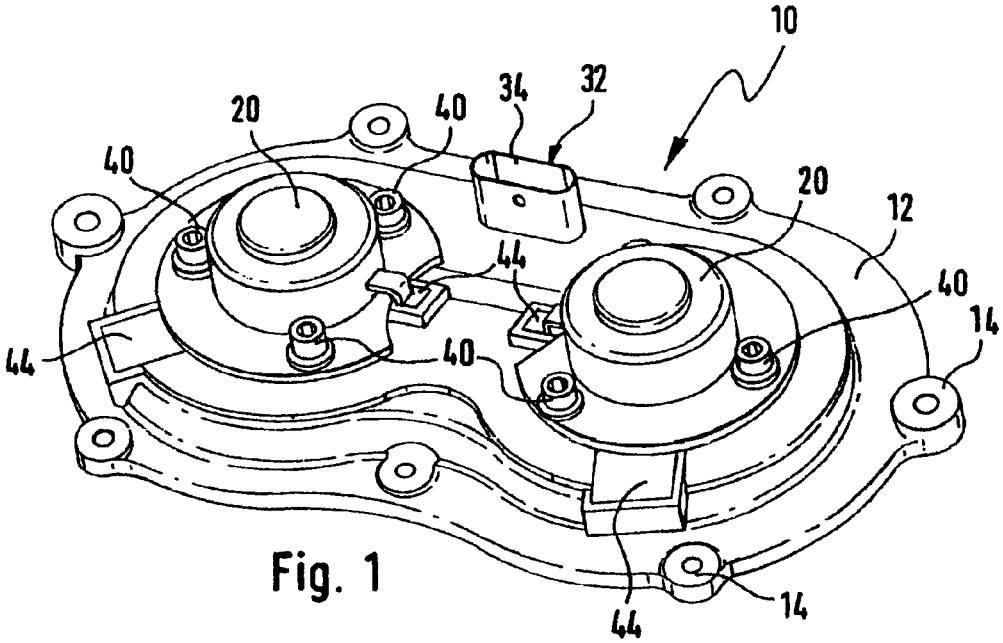
FIG. 1 shows an inclined top perspective view of an inventive magnet actuator.
Figure 2:
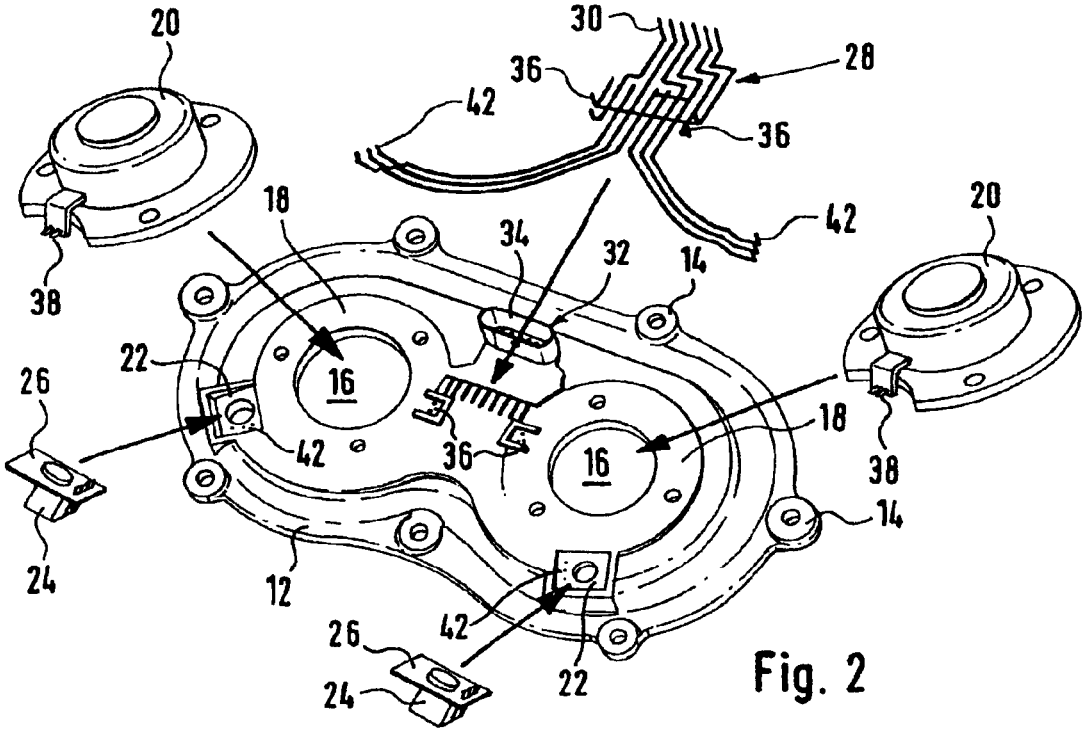
FIG. 2 shows an exploded view of the magnet actuator of FIG. 1.
Figure 3:
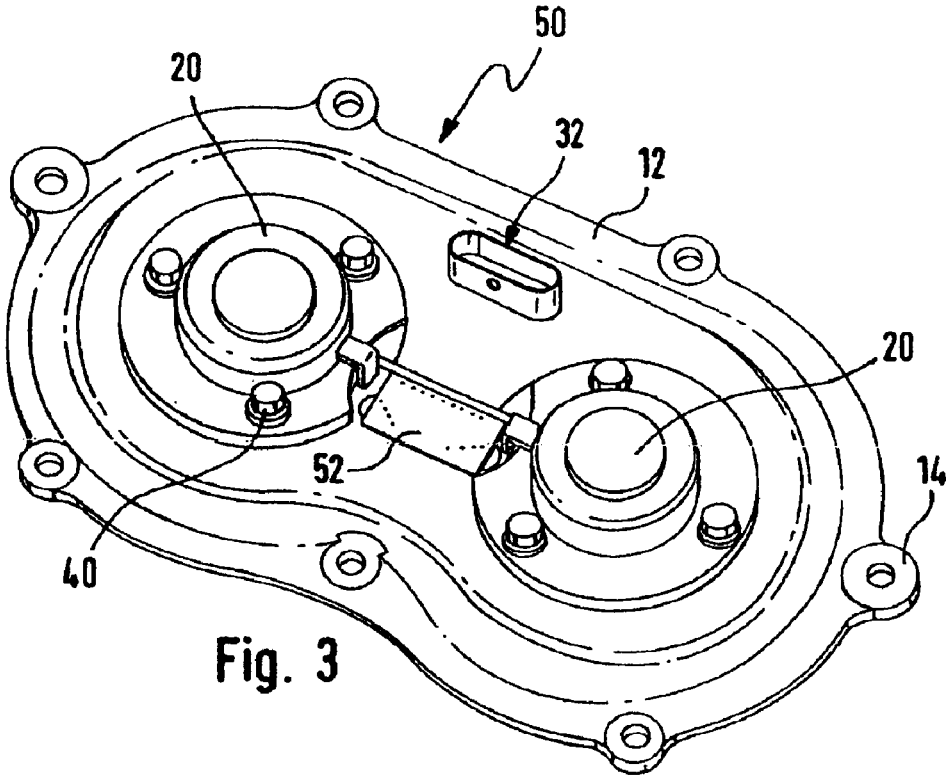
FIG. 3 shows an inclined top perspective view of a second inventive magnet actuator.
Figure 4:
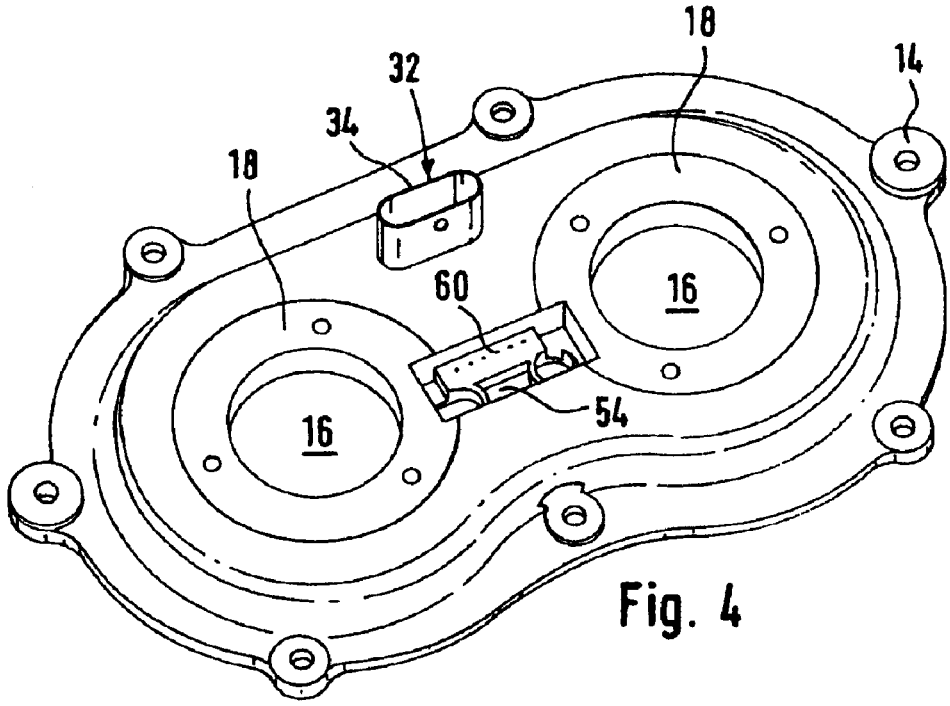
FIG. 4 shows the housing base body of the magnet actuator of FIG. 3.
Figure 6:
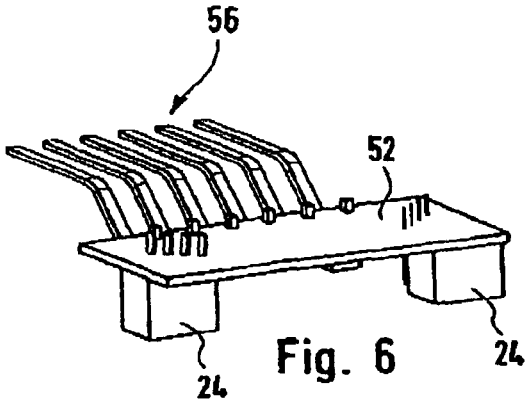
FIG. 6 shows a second individual single part of the magnet actuator of FIG. 3.

FIGS. 1 and 2 show an inventive magnet actuator 10 for a camshaft controller (not shown). The magnet actuator 10 comprises a housing base body 12 which can be flanged to a housing via mounting sections 14 which includes the camshaft and crankshaft of a combustion engine.

The housing base body 12 which can be screwed to a housing (not shown) of a combustion engine has two circular cylindrical openings 16 in accordance with FIG. 2. One receiving section 18 is provided about each of the openings 16, each for accepting one magnet body 20.

The housing base body 12 which is formed of plastic material, and which is preferably fiber glass reinforced, has two pockets 22 on its upper side for insertion of one sensor element 24 each. Each of the two sensor elements 24 (clearly shown in FIG. 2) is disposed on one circuit board 26. The surface structure of the pockets 22 corresponds substantially to the negative of the topography of the sensor elements 24 thereby ensuring secure seating of the sensor elements 24 in the pockets.

FIG. 2 shows the conductor paths 28 injected into the base body 12, whose free ends 30 terminate in a central electric connection 32. The free ends 30 of the conductor paths 28 are bent and project past the housing base body 12. They are protectingly surrounded by a plug connection 34 formed on the housing base body 12.

The free ends 36 of the conductor paths 28 project past the housing base body 12 in the region of the magnet bodies 20. In the mounted state, these free ends 36 are contacted with connecting means 38 provided on the magnet bodies 20. Contact is advantageously provided when the magnet bodies 20 are disposed in their predetermined position at the receiving sections 18. For permanent contact, the free ends 36 are advantageously soldered or welded to the connecting means. Mounting screws 40 are provided for mounting the magnet body 20 to the housing base body 12. Advantageously, sealing rings are inserted or injected between the housing base body 12 and the magnet bodies 20.

The conductor paths 28 have free ends 42 which extend within the housing base body 12 to the pockets 22. When inserting the sensor elements 24 including circuit boards 26, the circuit boards 26 contact the free ends 42 of the conductor path 28.

For permanent fixing of the sensor elements 24 including circuit boards 26 and connecting means 38 to the free ends 42 of the conductor paths 28, the corresponding regions are filled with compound 44 (see FIG. 1).

FIGS. 3 through 8 show a second embodiment of the inventive magnet actuator 50. The components corresponding to the magnet actuator 10 have corresponding reference numerals in the magnet actuator 50.

The magnet actuator 50 differs from the magnet actuator 10 in that the sensor elements 24 are disposed on a common circuit board 52. The circuit board 52 (clearly shown in particular in FIG. 6) is disposed in a recepticle 54 in the mounted state. The recepticle 54 is in the region between the two receiving sections 18.

Figure 5:
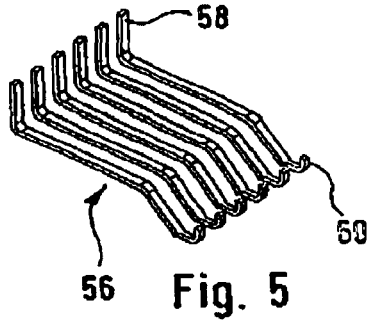
FIG. 5 shows a first individual single part of the magnet actuator of FIG. 3.
Figure 7:
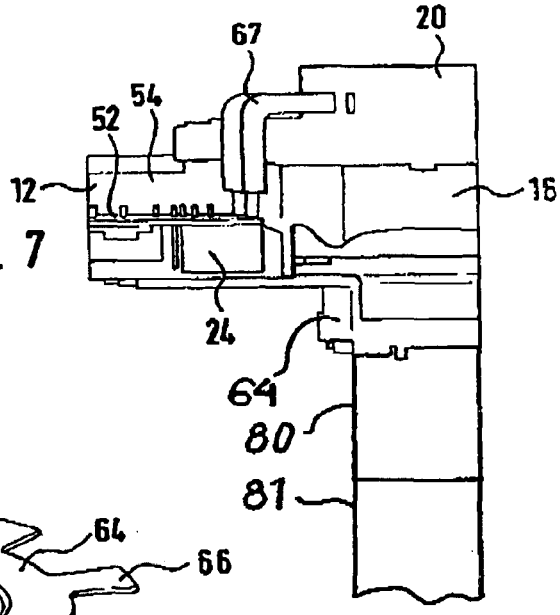
FIG. 7 shows a third individual single part of the magnet actuator of FIG. 3.
Figure 8:
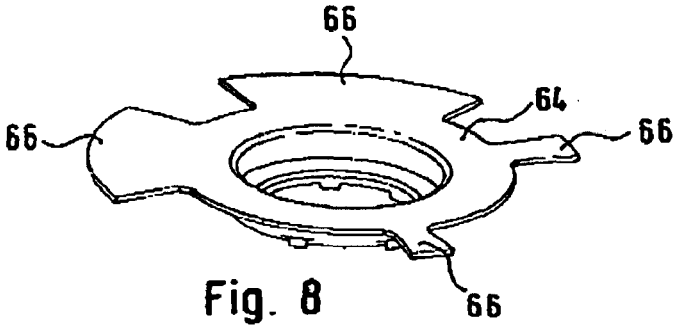
FIG. 8 shows a fourth individual single part of the magnet actuator of FIG. 3.

The conductor paths 56 shown in FIG. 5 extend from the central connection 32 to the recepticle 54, wherein the free ends 58 project past the housing base body 12 at the central connection 32. The free ends 60 of the mutually parallel conductor paths lying in a plurality of angled planar sections, project past the housing base body 12 in the region of the recepticle 54. When the circuit board 52 is inserted into the recepticle 54, the circuit board 52 is contacted by the free ends 60 (shown in FIG. 6). When the magnet body is disposed on the receiving sections 18, the connecting means 62 of the magnet bodies 20 are contacted with contacts of the circuit board 52. Current supply to the magnet bodies 20 is consequently effected via the circuit board 52 (clearly shown in FIG. 7).

When flanged to the housing (not shown) of the combustion engine, the side of the housing base body 12 facing away from the magnet body 20 has a transmission wheel 64 which cooperates with the respective sensor element 24 and which is coupled to the respective actuating means 80 or the respective camshaft 81 for secure mutual rotation therewith. The transmission wheel which follows the rotary motion of the actuating means 80 or the camshaft 81 has different transmission sections 66 which produce a sensor signal when they pass the sensor element 24. The transmission wheel 64 is preferably formed as a stamped and bent part which is inexpensive to produce.

The sensor elements 24 of the magnet actuator 50 are disposed coaxially to the longitudinal axis of the magnet bodies 20. The transmission sections 66 therefore extend substantially in a plane perpendicular to the longitudinal axis of the magnet bodies 20.

When the magnet bodies 20 are fed with current, a magnetic field acts on an armature (not shown) which is coupled to the actuating means 80 or the camshaft 81. Depending on the embodiment of the magnet bodies, the armature is either axially drawn-in or ejected in the direction of the magnet bodies 20 via the generated magnetic field thereby axially adjusting the actuating means 80.

Compared to the magnet actuator 10, the magnet actuator 50 has the advantage that the disposition of the sensor elements close to the central electric connection 32 greatly simplifies the conductor paths 56 compared to the conductor paths 28. Central arrangement of the sensor elements 24 moreover enables use of merely one circuit board 52 thereby permitting handling of the sensor elements 24, together with the circuit board 52 as a common pre-assembly group.

Both magnet actuator embodiments 10 and 50 are advantageous in that they can be mounted from the upper side. The individual components can be introduced at right angles to the base surface of the housing base body using an appropriate mechanical device.

When the circuit board 52 and the magnet bodies 20 are mounted, the recepticle 54 of the magnet actuator 50 can be sealed with a compound, as was the case for the magnet actuator 10.

All features represented in the description, the following claims and the drawing may be essential to the invention either individually or collectively in any arbitrary combination.

We claim:

1. A magnet actuator in a camshaft controller for axial displacement of an actuating means cooperating with a camshaft, the magnet actuator comprising:

a housing base body, said housing base body consisting essentially of plastic and defining at least one receiving section;

at least one magnetic body disposed at said receiving section, said magnetic body driving the actuating means to adjust a phase position of the camshaft;

an electrical connector communicating with said housing base body;

at least one sensor element mounted to said housing base body, said sensor element for detecting at least one of an adjustment and a motion of the camshaft; and rigid conductor paths provided on or embedded in said plastic of said housing base body, said conductor paths in electrical communication with said electrical connector and at least one of said magnet body and said sensor element.

2. The magnet actuator of claim 1, further comprising fiber glass reinforcement of said housing base body.

3. The magnet actuator of claim 1, wherein said housing base body defines at least one pocket for receiving one of said at least one sensor element.

4. The magnet actuator of claim 3, wherein said at least one pocket has a surface contour corresponding substantially to a negative of a topography of said sensor element.

5. The magnet actuator of claim 3, wherein said at least one pocket is disposed in a region between two of said receiving sections.

6. The magnet actuator of claim 5, further comprising a circuit board, wherein said housing base body defines a recepticle for receiving said circuit board.

7. The magnet actuator of claim 6, wherein said recepticle is in a region between two said receiving sections.

8. The magnet actuator of claim 6, wherein said conductor paths extend from said electrical connector to said recepticle to contact said circuit board.

9. The magnet actuator of claim 1, further comprising a circuit board on which said sensor element is disposed.

10. The magnet actuator of claim 9, wherein several sensor elements are disposed on one said circuit board.

11. The magnet actuator of claim 10, wherein all of said sensor elements are disposed on one said circuit board.

12. The magnet of claim 9, wherein said conductor paths are electrically connected to said at least one magnet body via said circuit board.

13. The magnet actuator of claim 9, wherein said at least one magnet body comprises electric connecting means which extend to and contact said circuit board.

14. The magnet actuator of claim 1, wherein all conductor paths extend parallel and proximate to each other and are preferably disposed in a sectionally coplanar manner.

15. The magnet actuator at claim 1, wherein said at least one sensor element extends coaxially to a longitudinal axis of said magnet body.

16. The magnet actuator of claim 1, further comprising at least one transmission wheel coupled to one of a respective actuating means and a respective camshaft for secure mutual rotation therewith, wherein each said sensor element detects one said transmission wheel.

17. The magnet actuator of claim 16, wherein said transmission wheel is formed as at least one of a stamped and a bent part.

18. The magnet actuator of claim 1, wherein said magnet body is a pressure magnet.

* * * * *